US008898999B1

(12) United States Patent
Kugler et al.

(10) Patent No.: US 8,898,999 B1
(45) Date of Patent: Dec. 2, 2014

(54) RESTRAINT SYSTEM FOR ELEVATED SURFACE TILES

(71) Applicant: United Construction Products, Inc., Denver, CO (US)

(72) Inventors: William E. Kugler, Denver, CO (US); Stephen J. Knight, III, Littleton, CO (US); Lisa K. von-Gunten, Denver, CO (US)

(73) Assignee: United Construction Products, Inc., Denver, CA (US)

( * ) Notice: Subject to any disclaimer, the term of this patent is extended or adjusted under 35 U.S.C. 154(b) by 0 days.

(21) Appl. No.: 14/091,726

(22) Filed: Nov. 27, 2013

(51) Int. Cl.
*E04B 1/00* (2006.01)
*E04F 15/02* (2006.01)

(52) U.S. Cl.
CPC ..... *E04F 15/02194* (2013.01)
USPC ..... 52/747.1; 52/126.6; 52/263; 52/284

(58) Field of Classification Search
CPC ..... E04F 15/02452; E04F 15/02458; E04F 15/02447; E04F 15/02464; H02G 3/285; H02G 3/385; E04G 11/48
USPC ..... 52/263, 283, 284, 126.6, 126.1, 126.5, 52/126.7, 262, 747.1, 745.13; 248/644, 248/677, 678, 351, 161, 188.4, 188.5, 248/188.8, 188.9, 346.01, 346.05, 346.06, 248/349.1, 354.3; 108/150; 254/354; 403/299
See application file for complete search history.

(56) References Cited

U.S. PATENT DOCUMENTS

| | | | |
|---|---|---|---|
| 2,294,240 | A | 8/1942 | Pollman |
| 2,830,332 | A | 4/1958 | Pawlowski |
| 3,425,179 | A | 2/1969 | Haroldson |
| 3,827,154 | A | 8/1974 | Kaifesh |
| 3,867,045 | A | 2/1975 | Beals |
| 3,923,277 | A | 12/1975 | Perrault et al. |
| 4,085,557 | A | 4/1978 | Tharp |
| 4,277,923 | A | 7/1981 | Rebentisch et al. |
| 4,356,636 | A | 11/1982 | Roberts |
| 4,558,544 | A | 12/1985 | Albrecht et al. |
| 4,590,678 | A | 5/1986 | Arredondo |
| 4,593,499 | A | 6/1986 | Kobayashi et al. |
| 4,736,555 | A | 4/1988 | Nagare et al. |

(Continued)

FOREIGN PATENT DOCUMENTS

EP 1304426 A2 4/2003

OTHER PUBLICATIONS

Bison Deck Supports, Bracing Specifications Brochure (Dec. 2005).

(Continued)

*Primary Examiner* — William Gilbert
*Assistant Examiner* — Gisele Ford
(74) *Attorney, Agent, or Firm* — Marsh Fischmann & Breyfogle LLP; Jonathon A. Szumny

(57) ABSTRACT

A support structure for elevating a building surface above a fixed surface including a plurality of support pedestals disposed in spaced-apart relation on the fixed surface, a plurality of stabilizing braces interconnecting adjacent of the plurality of support pedestals, and a plurality of restraint members. The restraint members include a mounting portion securable to one of the plurality of stabilizing braces and a restraint portion operatively attached to the mounting portion and securable to an outer edge segment of one or more of the surface tiles.

46 Claims, 12 Drawing Sheets

(56) References Cited

U.S. PATENT DOCUMENTS

| | | | | |
|---|---|---|---|---|
| 4,773,196 | A | 9/1988 | Yoshida et al. | |
| 4,780,571 | A | 10/1988 | Huang | |
| 4,841,708 | A | 6/1989 | Johnston | |
| 4,905,437 | A | 3/1990 | Heather | |
| 4,914,875 | A * | 4/1990 | Gustafson | 52/126.6 |
| 4,922,670 | A | 5/1990 | Naka et al. | |
| 4,965,936 | A | 10/1990 | Sentman | |
| 4,982,539 | A | 1/1991 | Hiller | |
| 4,996,804 | A | 3/1991 | Naka et al. | |
| 5,185,972 | A | 2/1993 | Markiewicz | |
| 5,301,480 | A * | 4/1994 | Oyama et al. | 52/126.6 |
| 5,333,423 | A | 8/1994 | Propst | |
| 5,377,417 | A | 1/1995 | Sentman | |
| 5,389,737 | A | 2/1995 | Kobayashi et al. | |
| 5,398,466 | A * | 3/1995 | Oyama et al. | 52/126.6 |
| 5,400,554 | A | 3/1995 | Lo | |
| 5,467,609 | A | 11/1995 | Feeney | |
| 5,477,649 | A * | 12/1995 | Bessert | 52/263 |
| 5,479,745 | A | 1/1996 | Kawai et al. | |
| 5,588,264 | A | 12/1996 | Buzon | |
| 5,680,732 | A | 10/1997 | Skouras | |
| 5,787,663 | A * | 8/1998 | Wehrmann | 52/263 |
| 5,791,096 | A | 8/1998 | Chen | |
| 5,862,635 | A | 1/1999 | Linse et al. | |
| 5,904,009 | A | 5/1999 | Huang | |
| 5,946,867 | A | 9/1999 | Snider et al. | |
| 6,332,292 | B1 | 12/2001 | Buzon | |
| 6,363,685 | B1 | 4/2002 | Kugler | |
| 6,370,831 | B1 | 4/2002 | Marshall et al. | |
| 6,442,906 | B1 | 9/2002 | Hwang | |
| 6,449,912 | B2 * | 9/2002 | Jette | 52/220.1 |
| 6,463,704 | B1 * | 10/2002 | Jette | 52/125.2 |
| 6,684,582 | B2 | 2/2004 | Peart et al. | |
| 6,772,564 | B2 | 8/2004 | Leon | |
| 6,857,230 | B2 | 2/2005 | Owen | |
| 6,983,570 | B2 | 1/2006 | Mead | |
| RE39,097 | E | 5/2006 | Schilham | |
| 7,140,156 | B1 | 11/2006 | Lowe et al. | |
| 7,168,212 | B2 * | 1/2007 | Jette | 52/220.5 |
| 7,290,375 | B2 * | 11/2007 | Kemeny | 52/167.1 |
| 7,360,343 | B1 | 4/2008 | Spransy et al. | |
| 7,373,759 | B1 | 5/2008 | Simmons | |
| 7,454,869 | B2 | 11/2008 | Owen | |
| 7,509,782 | B2 | 3/2009 | Colosimo et al. | |
| 7,698,860 | B2 | 4/2010 | Hockemeyer et al. | |
| 7,762,005 | B2 | 7/2010 | Pelotte | |
| 7,877,882 | B2 | 2/2011 | Burr | |
| 7,918,059 | B2 * | 4/2011 | Repasky | 52/263 |
| 7,921,612 | B2 | 4/2011 | Knight, III et al. | |
| 8,122,612 | B2 | 2/2012 | Knight, III et al. | |
| 8,156,694 | B2 * | 4/2012 | Knight et al. | 52/126.6 |
| 8,181,399 | B2 | 5/2012 | Knight, III et al. | |
| 8,297,004 | B2 * | 10/2012 | Knight et al. | 52/126.6 |
| 8,302,356 | B2 * | 11/2012 | Knight et al. | 52/263 |
| 8,381,461 | B2 * | 2/2013 | Repasky | 52/126.6 |
| 8,429,860 | B2 | 4/2013 | Kugler et al. | |
| 8,528,274 | B2 * | 9/2013 | Zlatar | 52/126.6 |
| 8,667,747 | B2 * | 3/2014 | Repasky | 52/126.5 |
| 2001/0011441 | A1 | 8/2001 | Jette | |
| 2001/0034987 | A1 | 11/2001 | Cooper et al. | |
| 2002/0003194 | A1 | 1/2002 | Simmons | |
| 2002/0014045 | A1 * | 2/2002 | Jette | 52/220.1 |
| 2002/0026757 | A1 | 3/2002 | Scissom et al. | |
| 2002/0078638 | A1 | 6/2002 | Huang | |
| 2002/0148173 | A1 | 10/2002 | Kugler | |
| 2003/0070372 | A1 | 4/2003 | Favero | |
| 2003/0101602 | A1 | 6/2003 | Galestien | |
| 2004/0035064 | A1 | 2/2004 | Kugler et al. | |
| 2004/0055232 | A1 | 3/2004 | Jette | |
| 2004/0074170 | A1 | 4/2004 | Huang | |
| 2004/0261329 | A1 | 12/2004 | Kugler et al. | |
| 2005/0284040 | A1 | 12/2005 | Hashimoto et al. | |
| 2007/0006540 | A1 * | 1/2007 | Linse | 52/263 |
| 2008/0053017 | A1 | 3/2008 | Hockemeyer et al. | |
| 2008/0053018 | A1 | 3/2008 | Hockemeyer et al. | |
| 2008/0105172 | A1 | 5/2008 | Repasky | |
| 2008/0222973 | A1 | 9/2008 | Lee et al. | |
| 2009/0173018 | A1 * | 7/2009 | Buzon | 52/126.6 |
| 2009/0183442 | A1 | 7/2009 | Repasky | |
| 2009/0188189 | A1 | 7/2009 | Repasky | |
| 2009/0199494 | A1 * | 8/2009 | Lee et al. | 52/126.6 |
| 2009/0206231 | A1 * | 8/2009 | Firman et al. | 248/677 |
| 2010/0050457 | A1 | 3/2010 | Knight et al. | |
| 2011/0011012 | A1 | 1/2011 | Knight, III et al. | |
| 2011/0016809 | A1 * | 1/2011 | Knight et al. | 52/263 |
| 2011/0023385 | A1 | 2/2011 | Knight, III et al. | |
| 2011/0138703 | A1 * | 6/2011 | Repasky | 52/126.6 |
| 2011/0138723 | A1 * | 6/2011 | Repasky | 52/309.1 |
| 2011/0185675 | A1 | 8/2011 | Knight et al. | |
| 2011/0239550 | A1 * | 10/2011 | Kugler et al. | 52/126.6 |
| 2012/0090252 | A1 * | 4/2012 | Zlatar | 52/126.6 |
| 2012/0131862 | A1 * | 5/2012 | Hashimoto et al. | 52/126.6 |
| 2012/0272588 | A1 * | 11/2012 | Kugler et al. | 52/126.6 |
| 2012/0272589 | A1 * | 11/2012 | Kugler et al. | 52/126.6 |
| 2012/0291369 | A1 | 11/2012 | Knight, III et al. | |
| 2013/0186015 | A1 * | 7/2013 | Meyer | 52/126.5 |
| 2013/0219809 | A1 * | 8/2013 | Tabibnia | 52/126.6 |
| 2013/0239492 | A1 * | 9/2013 | Cave et al. | 52/126.5 |
| 2013/0340358 | A1 * | 12/2013 | Danning | 52/126.7 |
| 2014/0123576 | A1 * | 5/2014 | Meyer | 52/126.6 |

OTHER PUBLICATIONS

Bison Deck Supports, Bracing Specifications and Design Requirements Brochure (2003).

Bison Deck Supports, Banded Bracing Specification Brochure (Feb. 2006).

Bison Screw Jack Specification Brochure (2003).

Brochure entitled "Assembly Instructions, Bison Level.It Adjustable Deck Supports", Bison Deck Supports, a United Construction Products, Inc. Company, dated 2005.

Brochure entitled "Complete Pedestal, Bison Level.It Adjustable Deck Supports", Bison Deck Supports, a United Construction Products, Inc. Company, dated Apr. 2007.

Brochure entitled "New Hanover Elevator Pedestal System", Hanover Architectural Products, dated 2007.

Eternoivica Catalogue Price List, pp. 58-67, dated 2008.

Brochure entitled "VersiJack 75", Elmich, dated May 2007.

* cited by examiner

RESTRAINT SYSTEM FOR ELEVATED SURFACE TILES

BACKGROUND OF THE INVENTION

1. Field of the Invention

This invention relates to the field of support structures for supporting an elevated surface above a fixed surface, such as for elevated floors, decks and walkways.

2. Description of Related Art

Elevated building surfaces such as elevated floors, decks, terraces and walkways are desirable in many environments. One common system for creating such surfaces includes a plurality of surface tiles, such as concrete tiles (pavers), stone tiles, clay tiles, or wood tiles, and a plurality of spaced-apart support pedestals upon which the tiles are placed to be supported above a fixed surface. For example, in outdoor applications, the surface may be elevated above a fixed surface by the support pedestals to promote drainage, to provide a level structural surface for walking, and/or to prevent deterioration of or damage to the surface tiles. The pedestals can have a fixed height, or can have an adjustable height such as to accommodate variations in the contour of the fixed surface upon which the pedestals are placed, or to create desirable architectural features.

Although a variety of shapes are possible, in many applications the surface tiles are rectangular in shape, having four corners. In the case of a rectangular shaped tile, each of the spaced-apart support pedestals can therefore support four adjacent surface tiles at the tile corners. Stated another way, each rectangular surface tile can be supported by four pedestals that are disposed under each of the corners of the tile. Large or heavy tiles can be supported by additional pedestals at positions other than at the corners of the tiles.

One example of a support pedestal is disclosed in U.S. Pat. No. 5,588,264 by Buzon, which is incorporated herein by reference in its entirety. The support pedestal disclosed by Buzon can be used in outdoor or indoor environments and is capable of supporting heavy loads applied by many types of building surfaces. The pedestal includes a threaded base member and a threaded support member that is threadably engaged with the base member to enable the height of the support pedestal to be adjusted by rotating the support member or the base member relative to the other. The support pedestal can also include an extender member (e.g., a coupling or coupler member) disposed between the base member and the support member for further increasing the height of the pedestal, if necessary.

Support pedestals are also disclosed in U.S. Pat. No. 6,363,685 by Kugler, U.S. Patent Publication No. 2004/0261329 by Kugler et al., and U.S. Pat. No. 8,122,612 by Knight, III et al., each of which is also incorporated herein by reference in its entirety.

SUMMARY OF THE INVENTION

One problem associated with some support structures for elevated surfaces is that the support structures may not provide adequate structural stability in certain unstable environments. As a result, the support structures may not be suitable for use in certain seismically active geographic areas, high wind areas or other locations that may be subject to disruptive vibrations of the fixed surface. Another problem associated with some support structures for elevated surfaces is that the safely obtainable height of the support pedestals may be limited due to the increasing instability of the support pedestals as the height of the pedestals, and hence the center of gravity of the pedestals, is increased. The increased height of the center of gravity further compounds the problems associated with disruptive vibrations of the underlying surface.

It is therefore an objective to provide a support structure for an elevated surface, where the support structure has improved structural stability. It is also an objective to provide a support structure that can enable the construction of an elevated surface having an increased height above the fixed surface as compared to existing support structures, particularly in areas that are prone to disruptive vibrations.

In this regard, one aspect presented herein is directed to a support structure for elevating a building surface above a fixed surface. The support structure includes a plurality of support pedestals disposed in spaced-apart relation on the fixed surface, a plurality of generally horizontally-disposed stabilizing braces interconnecting adjacent of the plurality of support pedestals and each having first and second ends attached to central sections of the adjacent support pedestals, and a plurality of restraint members that each include a mounting portion secured to one of the plurality of stabilizing braces and a restraint portion secured to an outer edge segment of at least a first of a plurality of surface tiles.

Another aspect disclosed herein is directed to an elevated building surface assembly that includes a plurality of support pedestals disposed in spaced-apart relation on a fixed surface, a plurality of stabilizing braces operatively attached to and interconnecting adjacent support pedestals, a plurality of building surface components operatively disposed on the upper portions of the support pedestals, and a plurality of restraint members interconnecting the building surface components to the stabilizing braces. Each restraint member includes a mounting portion secured to one of the plurality of stabilizing braces and a restraint portion secured to an outer edge segment of at least a first of the plurality of building surface components.

A further aspect disclosed herein is directed to a method for restraining surface tiles of an elevated building surface that includes a plurality of support pedestals on a fixed surface in a spaced-apart relationship and where stabilizing braces are attached to adjacent ones of the plurality of support pedestals to interconnect the adjacent support pedestals. The method includes securing mounting portions of restraint members to the stabilizing braces, placing corner portions of surface tiles on the support pedestals to form an elevated building surface and receiving restraint portions of the restraint members in openings in outer edge segments of the surface tiles.

In accordance with the foregoing embodiments and aspects, the support structure can provide increased structural stability. In one aspect, the support structure can be used to support elevated surfaces in seismically active geographic areas or in other areas where disruptive vibrations may occur, such as a train platform. Through interconnection of the support pedestals, the support pedestals can move in unison during a seismic event or other vibratory disruption to maintain the desired spacing between the support pedestals, and therefore continue to safely support surface tiles placed on the support pedestals and maintain the integrity of the building surface.

In addition to the exemplary aspects and embodiments described above, further aspects and embodiments will become apparent by reference to the drawings and by study of the following descriptions.

DESCRIPTION OF THE INVENTION

Figure 1:
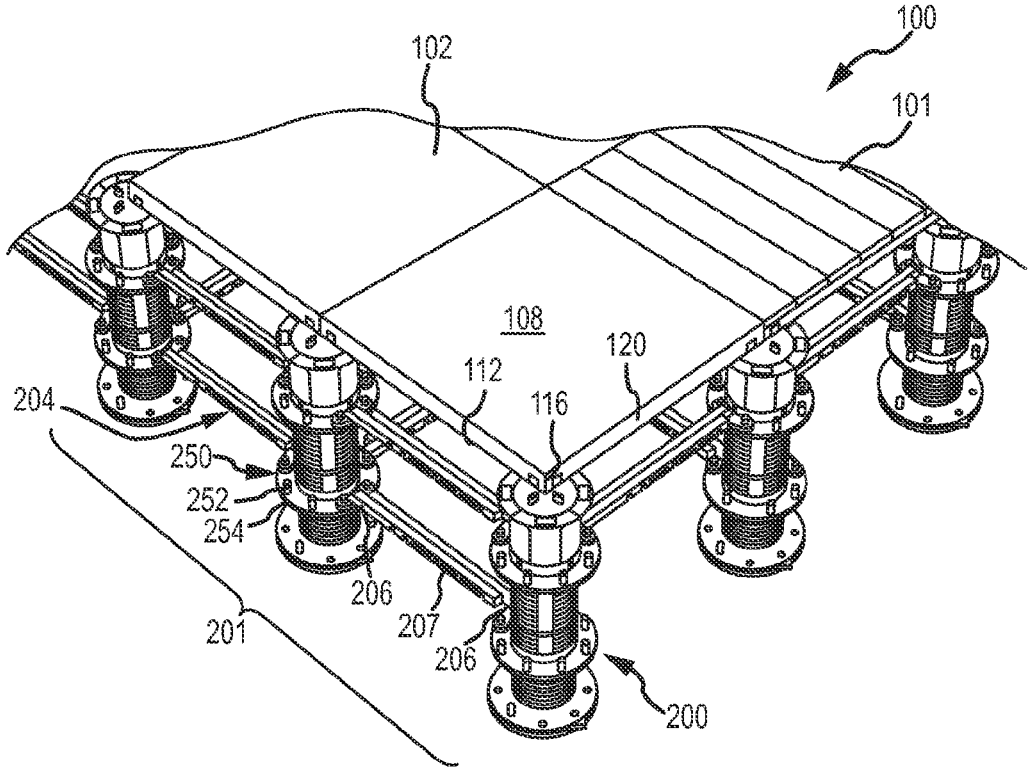
FIG. 1 illustrates a perspective view of a stabilized elevated building surface assembly.

FIG. 1 illustrates a portion of an elevated building surface assembly 100 that includes a building surface 101 formed from a plurality of surface tiles 102. The surface tiles 102 are elevated above a fixed surface by a support structure 200 comprising a plurality of spaced-apart support pedestals 201 which are interconnected by a plurality of stabilizing braces 204. Each surface tile 102 may broadly include generally opposing top and bottom surfaces 108, 112, one or more corner portions 116, and one or more outer edge segments 120 disposed between adjacent corner portions 116. The surface tiles 102 can be comprised of virtually any material from which a building surface is constructed. Examples include, but are not limited to, slate tiles, natural stone tiles, composite tiles, concrete tiles (e.g., pavers), wooden deck tiles, particularly hardwood deck tiles, tiles of metal or fiberglass grating, porcelain, and the like.

The support pedestals 201 can be placed in a spaced-apart relation on fixed surfaces including, but not limited to, rooftops, plazas, over concrete slabs including cracked or uneven concrete slabs, and can be placed within fountains and water features, used for equipment mounts, and the like. The elevated building surface assembly 100 can be used for both interior and exterior applications. For instance, each of the surface tiles 102 may be placed upon several support pedestals 201 to elevate the tile 102 above the fixed surface. As illustrated in FIG. 1, the surface tiles 102 may be square and a support pedestal 201 may be disposed beneath four corners of adjacent surface tiles 102. Although illustrated in FIG. 1 as being laid out in a symmetric square pattern, the support pedestals 201 can also be laid out in various configurations as may be dictated by the shape and size of the surface tiles, such as a rectangular configuration or a triangular configuration to support rectangular or triangular surface tiles.

The support pedestals 201 are interconnected by a plurality of stabilizing braces 204 that are attached to the support pedestals 201 in any appropriate manner and that operatively connect each support pedestal 201 with one or more adjacent support pedestals 201 to form a stable support structure 200 (e.g., where the braces 204 may be vertically spaced at any appropriate distance from the surface tiles 102, such as a third of the distance between the surface tiles 102 and the fixed surface, halfway between the surface tiles 102 and the fixed surface, and/or the like). For instance, each brace 204 broadly includes first and second end portions 206 configured to respectively attach to first and second adjacent support pedestals 201 as well as an elongate central portion 207 between the first and second end portions 206. The end portions 206 are adapted to be connected to a support pedestal, and in this regard can include one or more brace attachment elements adapted to secure the brace 204 to a support pedestal 201.

In one arrangement, the brace attachment elements may include apertures adapted to fit over a knob or similar structure on a support pedestal 201 for attaching the braces 204 to a support pedestal 201. Alternatively, the end portions 206 could include other attachment elements for attachment to a support pedestal 201, such as attachment knobs projecting from the braces 204 or the like. The braces 204 can have a variety of sizes, shapes and configurations (e.g., adjustable or telescopic, non-adjustable, etc.) and be constructed from one or more materials (e.g., plastics, wood, metals, composite materials, etc.). For instance, the stabilizing braces 204 may include those disclosed in U.S. Pat. No. 8,429,860 by Kugler et al. or U.S. Pat. No. 8,181,399 by Knight, III et al., each of which is hereby incorporated herein by reference in its entirety as if set forth in full.

The stabilizing braces 204 interconnecting the support pedestals 201 can advantageously enhance the stability of the support structure 200 as compared to a structure utilizing support pedestals that are not interconnected and are free to move independently with respect to other support pedestals. For example, if one or more of the support pedestals 201 shift, such as during a seismic event or other disruption, the braces 204 may cause the interconnected support pedestals 201 to move essentially in unison such that the spacing between adjacent support pedestals remains substantially fixed. Therefore, the surface tiles 102 may remain supported above the fixed surface and the integrity of the building surface 101 may be maintained. In one arrangement, neither the braces 204 nor the support pedestals 201 are attached to the fixed surface.

The utilization of such stabilizing braces 204 to interconnect the support pedestals 201 can also increase the safely obtainable height of the support pedestals. That is, the braces 204 can provide sufficient structural stability such that support pedestals 201 having a higher center of gravity can be safely utilized to elevate the building surface without undue risk of the building surface collapsing. The braces 204 are therefore adapted to interconnect the support pedestals 201 and provide a sufficiently rigid lateral connection between the support pedestals such that the support pedestals move in unison, and such that the spacing among the support pedestals does not substantially change due to seismic events, wind events or other events that can cause movement of the building surface.

Thus, stabilizing braces are utilized to interconnect a plurality of support pedestals to form a support structure that supports the surface tiles to form the elevated building surface. The support pedestals that are useful for forming the support structure can have a variety of configurations. The support pedestals can have a fixed height, or can be height-adjustable support pedestals. Further, any combination of fixed height and height-adjustable support pedestals can be used to form the support structure. The support pedestals can also be fabricated from a variety of materials. Preferably, the support pedestals are fabricated from a non-metallic material, such as plastic that is resistant to rot and corrosion.

Figure 2:
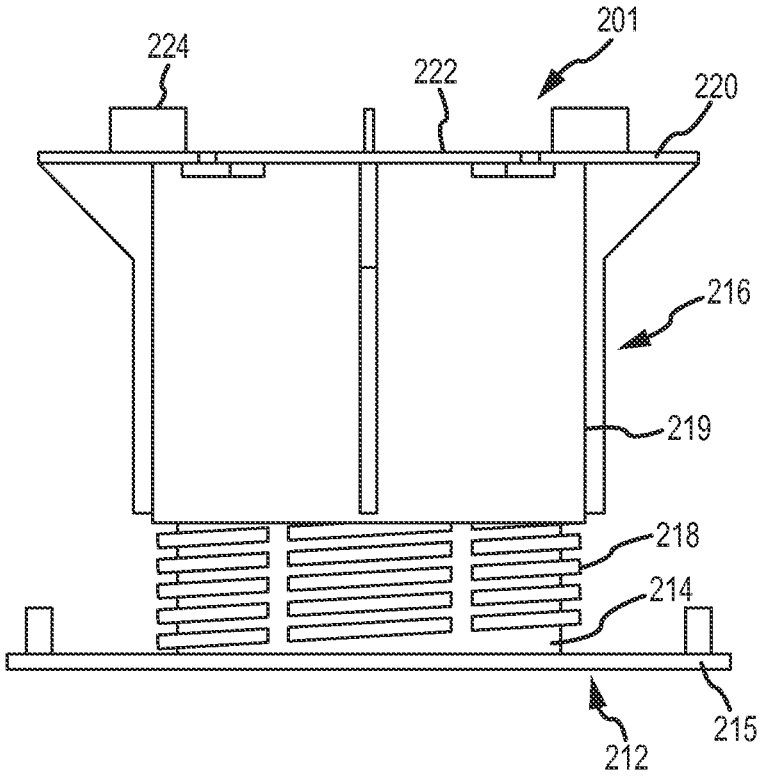
FIG. 2 illustrates a side view of a support pedestal that is useful in a support structure for elevating a surface.

FIG. 2 illustrates a side view of one exemplary support pedestal 201 that broadly includes a lower portion that is adapted to be placed upon a fixed surface, an upper portion for receiving a surface tile 102, and a central section extending between or interconnecting (e.g. perpendicularly) the upper and lower portions. For instance, the support pedestal 201 may include a base member 212 having a cylindrical base member extension 214 that extends upwardly from a base member plate 215 when the support pedestal 201 is operatively placed on a fixed surface. In one arrangement, the support pedestal 201 illustrated in FIG. 2 is a height-adjustable support pedestal. In this regard, the base member 212 may include base member threads 218 on a surface of the base member extension 214.

The support pedestal 201 may also include a support member 216 that is adapted to be operatively connected to the base member 212 and that includes a support plate 220 and a cylindrical support member extension 219 that extends downwardly from the support plate 220. The support member 216 includes support member threads (not illustrated) on an interior surface of the support member extension 216 that are adapted to threadably engage base member threads 218 to connect the support member 216 to the base member 212. Thus, the support member 216 can be mated directly to base member threads 218 and they can be rotated relative to each other. The support plate 220 is thereby disposed above the base member 212 to support surface tiles thereon. Although illustrated as having internal threads on the support member 216 and external threads on the base member 218, it will be appreciated that other configurations are possible, including external threads on the support member and internal threads on the base member. The support pedestal could also have a fixed height.

The support plate 220 includes a top surface 222 upon which the corners of adjacent surface tiles can be placed. Spacers 224 can be provided on the top surface 222 of the support plate 220 to provide predetermined spacing between adjacent surface tiles that form the elevated building surface. For example, the spacers 224 can be disposed on a crown member that is placed in a recess on the top surface 222 of the support plate 220. In this manner, the crown member can be rotated independent of the support member 216 to adjust the position of the spacers 224.

Figure 3:
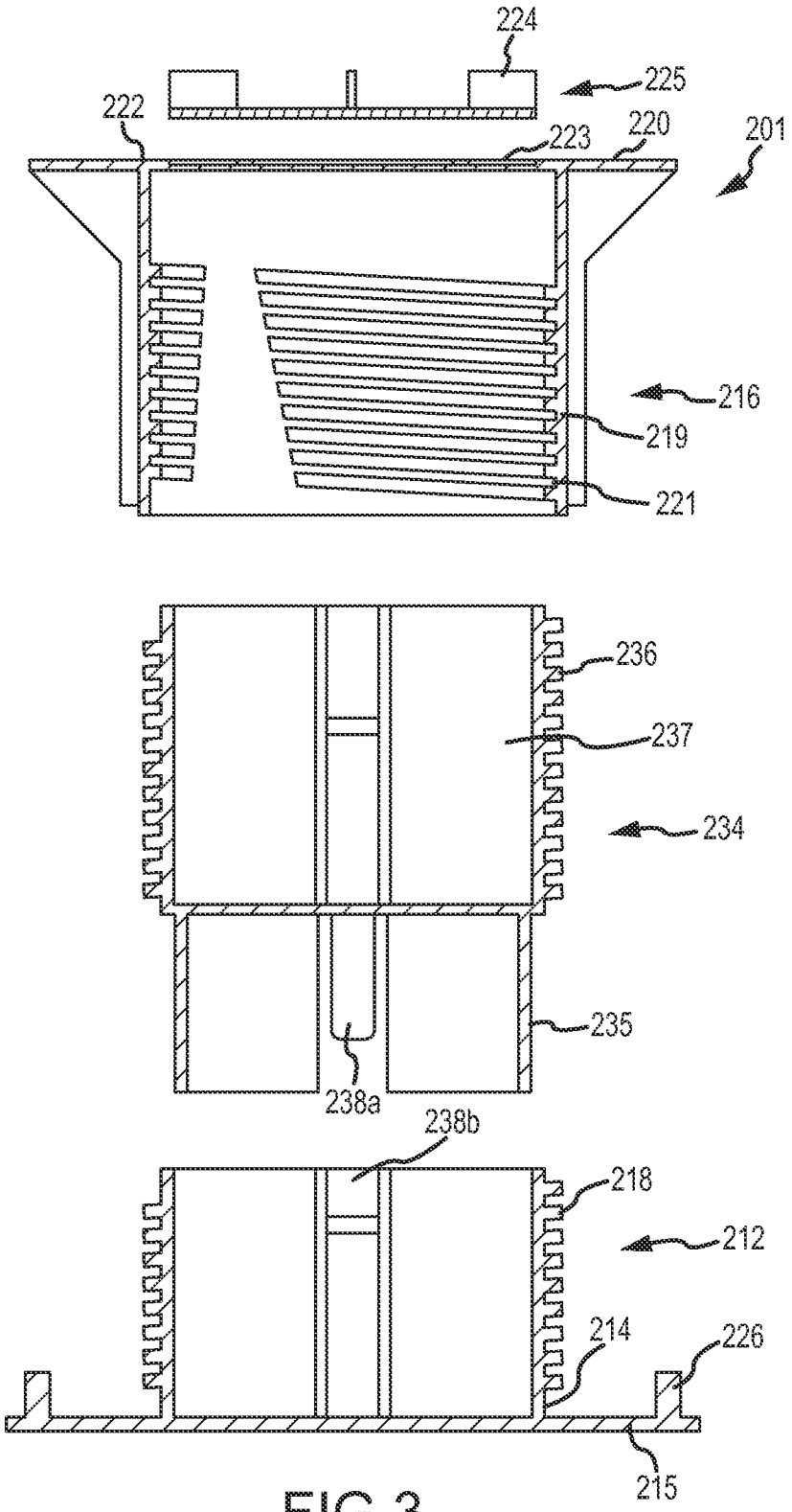
FIG. 3 illustrates a cross-sectional exploded side view of a support pedestal including an extender member that is useful in a support structure for elevating a building surface.
Figure 4:
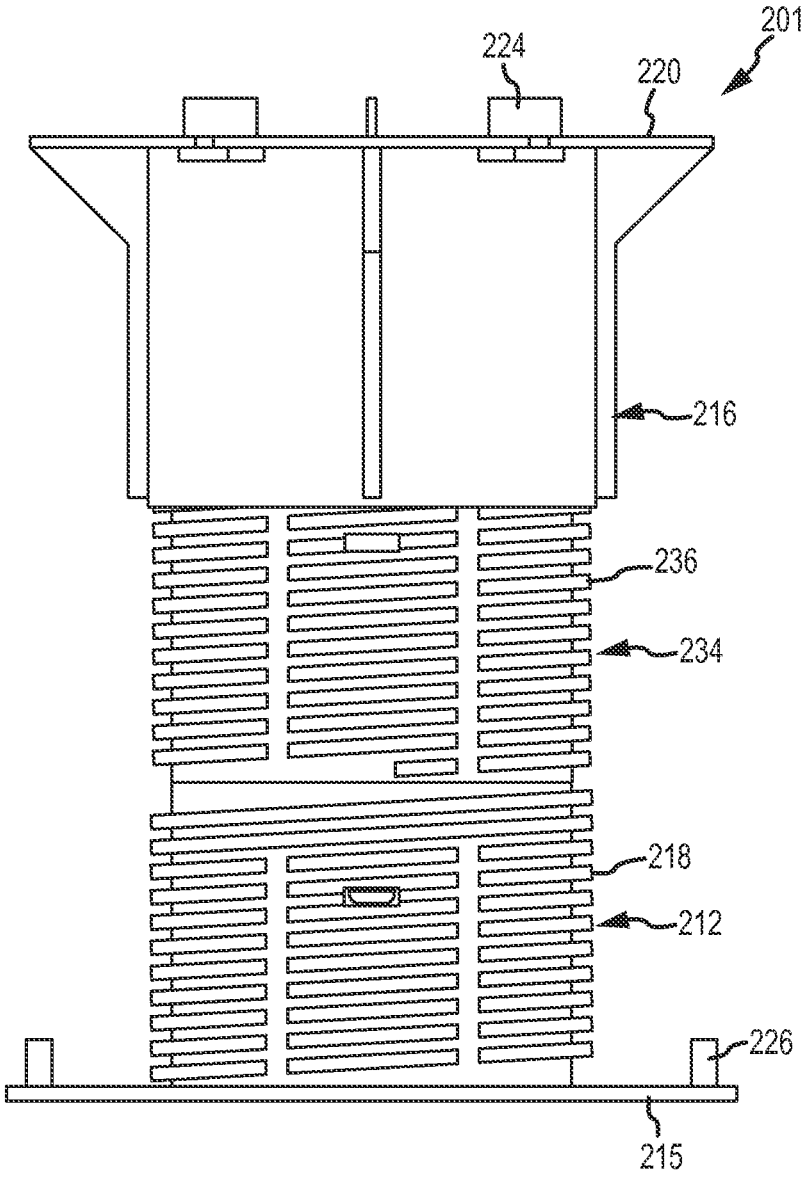
FIG. 4 illustrates a side view of the support pedestal of FIG. 3 in an assembled configuration.

FIG. 3 illustrates a cross-sectional exploded view of another exemplary support pedestal, including an optional extender or coupling member, that can be useful in a support structure, and FIG. 4 illustrates a side view of the assembled support pedestal including the optional extender member. Referring to FIGS. 3 and 4, the support pedestal 201 includes a base member 212 having a base member plate 215 that is adapted to be placed upon a fixed surface. The base member includes a cylindrical base member extension 214 extending upwardly from the base member plate 215 when the support pedestal 201 is operatively placed on a fixed surface. The base member extension 214 includes base member threads 218 disposed on an outer surface of the base member extension 214.

The support pedestal 201 also includes a support member 216 having a support plate 220 and a cylindrical support member extension 219 that extends downwardly from the support plate 220. A crown member 225 including tile spacers 224 is adapted to be placed in a recess 223 on the top surface 222 of the support member 216. In this manner, after placement of the support pedestal 201, the crown member 225 can be freely rotated in the recess 223 to accommodate the positioning of the surface tiles.

The support member 216 also includes support member threads 221 disposed on an inner surface of the support member extension 219. The support member threads 221 are adapted to rotatably engage the base member threads 218 to directly connect the support member 216 to the base member 212. In this manner, the height of the support pedestal 201 can be adjusted by rotating the support member 216 or the base member 212, relative to the other.

As illustrated in FIGS. 3 and 4, the support pedestal 201 may also include an extender member 234 (e.g., an extension member) that may be interconnected (e.g., perpendicularly) between the base member 212 and the support member 216 of the support pedestal 201 for increasing the height of the support pedestal 201. The extender member 234 includes a first cylindrical portion 235 that is adapted to slidably engage with the base member extension 214, and includes a second cylindrical portion 237 that includes extender member threads 236 that are adapted to rotatably engage with the support member threads 221. It is important to note that the timing of the coupling member threads 236 with the base member threads 218 should be synchronized when the extender member 234 is placed in the base member 212. As a result, the support member threads 221 can fully engage the extender member threads 236 and continue to thread onto the base member threads 218 without binding. In this way, the support pedestal 201 can be fully adjusted through a wide range of heights without any gaps in the obtainable pedestal height.

In the embodiment illustrated in FIGS. 3 and 4, the extender member 234 also includes an alignment member **238*a* that is adapted to mate with an alignment member 238*b* in the base member 212 to insure the timing of the extender member threads 236 with the base member threads 218. Thus, the extender member 234 can engage both the support member 216 and the base member 212 to couple the support member 216 to the base member 212 and provide an increased height for the support pedestal 201. The support pedestal 201 may also include attachment knobs 226 disposed around the perimeter of the support pedestal. The attachment knobs 226** are adapted to be placed through apertures in a stabilizing brace to secure the brace to the support pedestal.

In one embodiment, a stabilizing collar 250 including a plurality of pedestal attachment elements may be disposed on the support pedestals 201 for attaching the braces 204 to the support pedestals 201. See FIG. 1. For instance, each stabilizing collar 250 may include a plurality pedestal attachment elements such as attachment knobs 252 disposed on a flange 254 extending around the perimeter of the stabilizing collar 250. The flange 254 may extend substantially orthogonally from an internal threaded portion (not shown) of the stabilizing collar 250 that is adapted to be threadably engaged with external threads (e.g., threads 218, 236, etc. in FIGS. 2-3) of a support pedestal 201 to attach the stabilizing collar 250 to the support pedestal. In this regard, the end portions 206 of the braces 204 can include apertures that are adapted to fit over the attachment knobs 252 to secure the braces to the stabilizing collar 250, and hence to attach the braces 204 to the support pedestals 201. It will also be appreciated that the stabilizing collar could include attachment elements that are apertures, such as where the stabilizing braces include similarly configured attachment knobs that are adapted to fit into the apertures. Examples of stabilizing collars and the like are disclosed in U.S. Patent App. Pub. No. 2012/0291369 by Knight, III et al. and U.S. Pat. No. 8,429,860 by Kugler et al.

In some situations, it may be desirable or even necessary (e.g., to meet safety requirements and/or building codes) to restrain or limit movement of one or more of the surface tiles 102 to the support structure 200 (e.g., limit movement of the surface tiles 102 away from the support structure 200). As discussed previously, for instance, seismically active geographic areas may be subject to disruptive vibrations that can dislodge surface tiles 102 from the support structure 200 and thereby create a possibly dangerous environment requiring subsequent repair. As another example, some surface tiles 102 may be susceptible to movement due to pressure differences above and below the tiles, such as from strong wind blowing across the surface tiles that generates uplift forces and dislodges surface tiles.

Figure 5:
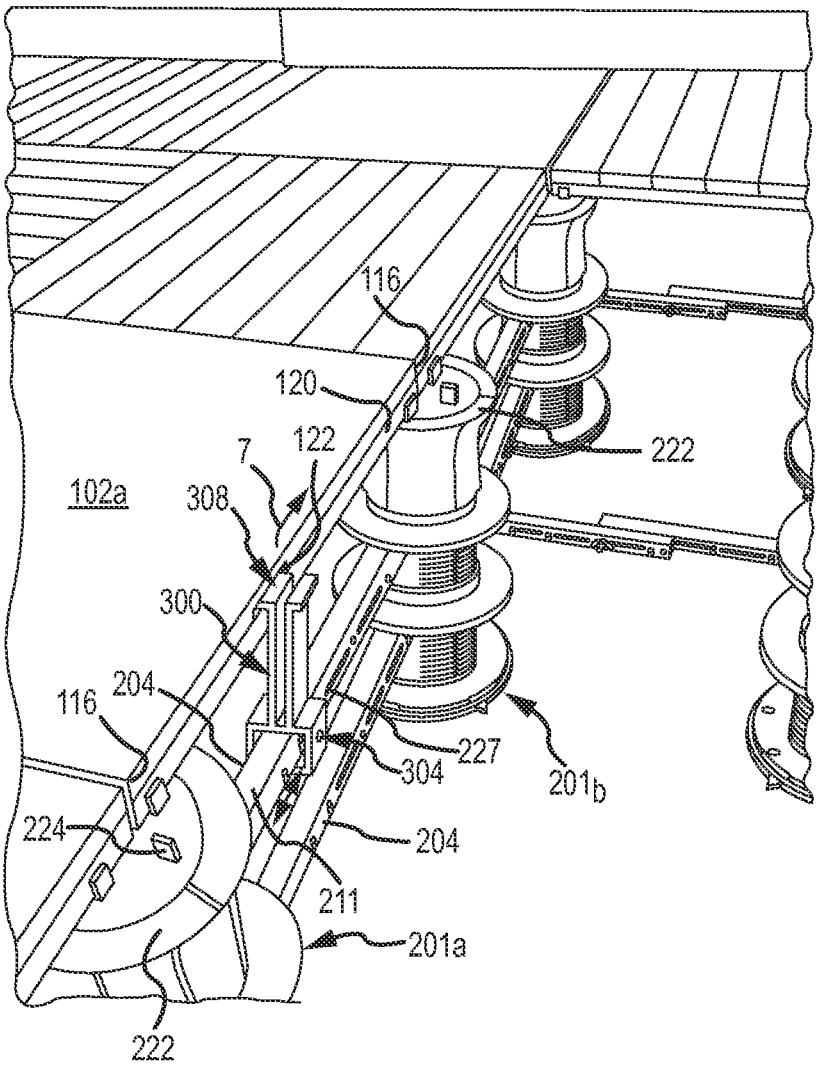
FIG. 5 is a perspective view of a partially assembled elevated building surface assembly including a restraint member configured to restrain one or more surface tiles against movement away from the support structure.
Figure 6:
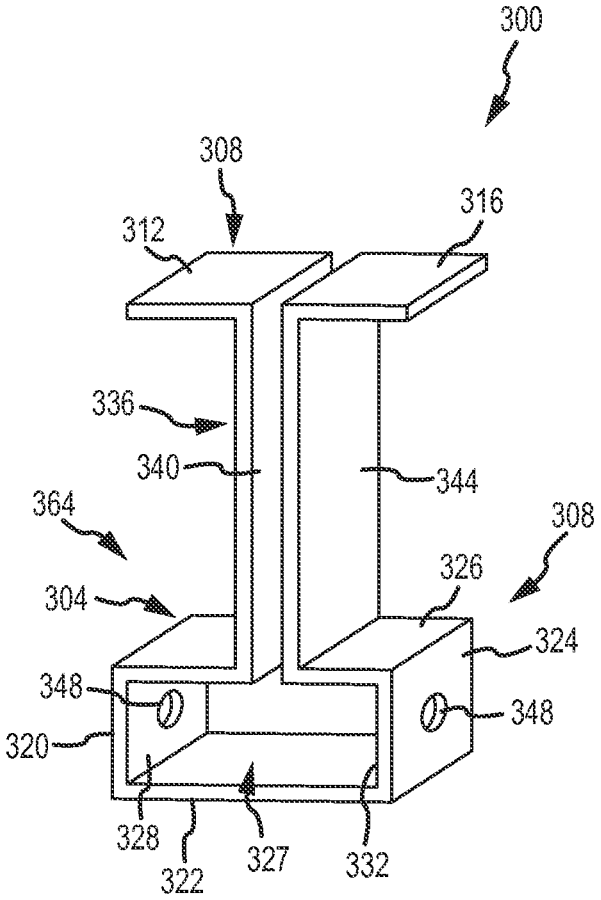
FIG. 6 is a perspective view of the restraint member of FIG. 5.
Figure 7:
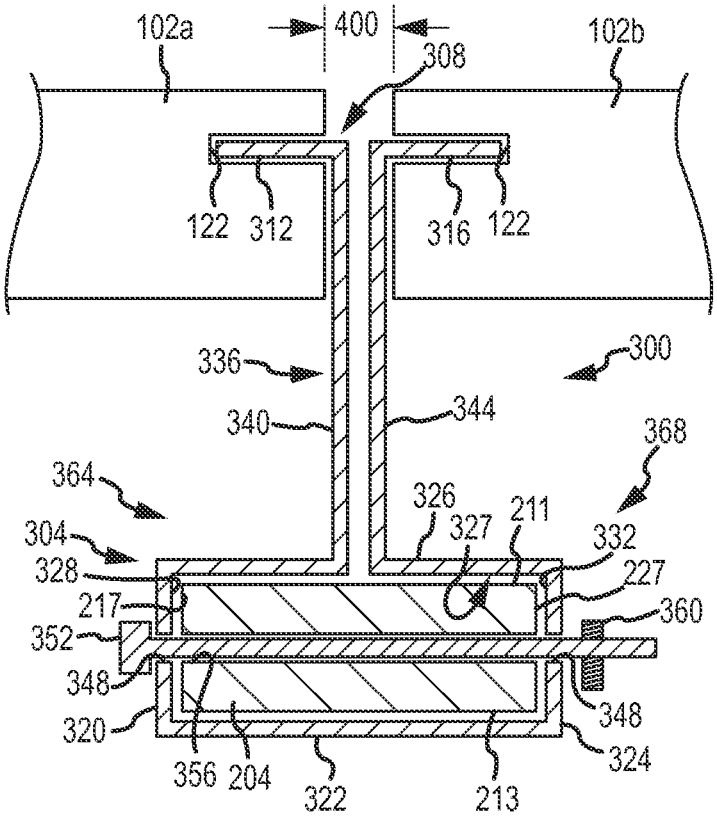
FIG. 7 is a sectional view along the line 7-7 in FIG. 5.

In this regard, and turning now to FIGS. 5-7, a restraint member 300 is illustrated that may be utilized for interconnecting one or more surface tiles 102 to one or more of a plurality of stabilizing braces 204 of a support structure 200 to facilitate movement of an elevated building surface assembly 100 as a single unit during disruptive vibrations, pressure differences from strong wind, and the like. Stated differently, the restraint member 300 serves to limit movement of the surface tiles 102 away from the support structure 200 (e.g., in a direction that may otherwise dislodge the surface tiles 102 from the support structure 200). Broadly, the restraint member 300 includes a mounting portion 304 secured or securable to at least one of the stabilizing braces 204, and a restraint portion 308 secured or securable to an outer edge segment 120 of at least one of the surface tiles 102 (at a position between adjacent corner portions 116 of the surface tiles 102 and between adjacent support pedestals 201) to limit movement of the surface tile 102 away from the support structure 200. The mounting and restraint portions 304, 308 may be connected by a connection portion 336. Furthermore, it is to be understood that the support pedestals 201, stabilizing braces 204, etc. may be the same as or different than those shown in FIG. 1.

Broadly, the mounting portion 304 includes one or more mounting elements securable to one or more surfaces or portions of the stabilizing brace 204 in any appropriate manner. In one arrangement, the mounting portion 304 may include one or more of a bottom wall 322, a top wall 326, first side wall 320, and second side wall 324 that may be respectively configured to overlay or abut a bottom wall 213, top wall 211, first side wall 217, and second side wall 227 of the stabilizing brace 204. See FIGS. 5 and 7. For instance, the top wall 326 of the mounting portion 304 may be disposed over the top wall 211 of the stabilizing brace and the bottom wall 322 of the mounting portion 304 may be disposed underneath the bottom wall 213 of the stabilizing brace 204. In one arrangement, the mounting elements (e.g., the walls) may collectively form a mounting cavity 327 for receipt of the stabilizing brace 204. For instance, the mounting cavity 327 may include first and second spaced-apart mounting surfaces 328, 332 for respective receipt of first and second opposing portions of the stabilizing brace 204 (e.g., respectively adjacent first and second side walls 217, 227 of the stabilizing brace 204). In one arrangement, the bottom wall 322, top wall 326, first side wall 320, and second side wall 324 may be configured to encompass a periphery of the stabilizing brace 204 to limit relative movement between the restraint member 300 and the stabilizing brace 204 in side to side (lateral) and/or up and down (vertical) directions.

As used herein in relation to the restraint member 300, the term "secured" and variations thereof (e.g., secure, securable) means at least substantially non-movable relative to at least one direction or along at least one axis. As just one example, the bottom wall 322 of the mounting portion 304 serves to secure the mounting portion 304 to the stabilizing brace 204 because the bottom wall 322 would, upon application of an uplift force on the restraint member 300 (e.g., in a direction away from the bottom wall 322 towards the restraint portion 308), abut the bottom wall 213 of the stabilizing brace 204 and thereby limit movement of the restraint member 300 in a direction away from the stabilizing brace 204. In this regard, the terms secured and variations thereof (e.g., securable) do not necessarily mean affixing via screws, bolts, etc., adhering, and/or the like (although the terms secured and variations thereof could encompass doing so).

At least one of the elements or walls of the mounting portion 304 may include one or more mounting apertures 348 for receipt of one or more fasteners therethrough. For instance, a fastener 352 (e.g., bolt) may be inserted through aligned mounting apertures 348 in first and second side walls 320, 324 of the mounting portion 304 as well as through one or more aligned apertures 356 in the stabilizing brace 204. A nut 360 may be threaded onto an end of the fastener 352 to secure the mounting portion 304 and thus secure the restraint member 300 as a whole to the stabilizing brace 204. Furthermore, the mounting portion 304 may be secured to the stabilizing brace 204 before or after the stabilizing brace 204 is secured to either or both of first and second adjacent support pedestals $\mathbf{201}_a$, $\mathbf{201}_b$ of the support structure 200. While pre-drilled mounting apertures 348 are illustrated in FIG. 6, other arrangements envision that openings may be formed in the mounting portion 304 at or near the time of mounting onto the stabilizing brace 204 (e.g., via drilling or the like). For instance, the fasteners 352 could be configured to self-tap into one or both of the mounting portion 304 and the stabilizing brace 204 (e.g., without requiring pre-formed apertures). Furthermore, while only a single fastener 352 has been shown in FIG. 7, more than one fastener may be inserted through a particular mounting portion 304 and corresponding stabilizing brace 204.

In one arrangement, any appropriate indicia (e.g., marks, texturing, dimpling, etc.) may be disposed on the mounting portion 304 and/or stabilizing brace 204 to convey to an installer where apertures are to be formed. Furthermore, other manners of securing the mounting portion 304 to the stabilizing brace 204 are also envisioned such as via spring-loaded locking members, flexible tangs/snaps/clips, adhesives, welding, and/or the like. In any event, the fasteners 352 and/or other manners of securement between the mounting portion 304 and the stabilizing brace 204 generally serve to limit one or more of lateral (e.g., sliding) movement of the mounting portion 304 along the stabilizing brace 204, up and down (e.g., vertical) movement of the mounting portion 304 relative to the stabilizing brace 204, and forward and backward movement of the mounting portion 304 relative to the stabilizing brace (e.g., perpendicular to the stabilizing brace 304).

As mentioned previously, the restraint portion 308 is operatively connected to the mounting portion 304 (e.g., through connection portion 336) and is securable to the outer edge segment 120 of at least one of the surface tiles 102 to limit movement of the surface tile 102 away from the stabilizing brace 204. In one arrangement, the restraint portion 308 may be configured to be operatively positioned within an opening 122 (e.g., slot, aperture, elongated hole, etc.) disposed in the outer edge segment 120 of the surface tile 102. For instance, at least one opening 122 may be disposed about halfway along the length of the outer edge segment 120 and at any appropriate depth into the surface tile 102. As another example, first and second openings 122 may be offset from the halfway point, such as by being respectively disposed at about ⅓ and ⅔ along the length of the outer edge segment 120. As a further example, the opening 122 may be in the form a slot that runs along an entirety (or substantial entirety) of the length of the outer edge segment 120. Furthermore, each of the at least one opening 122 may be disposed at any appropriate distance between the top and bottom surfaces 108, 112 of the surface tile 102, such as over a midpoint between the top and bottom surfaces 108, 112, offset from the midpoint as shown in FIG. 7, and/or the like. In one arrangement, at least one opening 122 may be in the form of a depression in the top surface 108 of the surface tile 102 and of a depth towards the bottom surface 112 that is substantially the same as the thickness of the restraint portion 308.

In one arrangement, the restraint portion 308 may include one or more restraint elements such as first and/or second restraint tabs 312, 316 that are respectively configured to be received in openings 122 in the outer edge segments 120 of first and second abutting surface tiles $\mathbf{102}_a$, $\mathbf{102}_b$ (surface tile $\mathbf{102}_b$ not shown in FIG. 5 in the interest of clarity). As used herein, the term "abutting" and variations thereof (e.g., abut, abuts) indicate a facing and closely spaced relative positioning (e.g., direct contact, separated by only a slight gap, such as provided by spacers 224, etc.) between components (e.g., between outer edge segments 120 of a pair of adjacent surface tiles 102). When received in the openings 122 of the first and second surface tiles $\mathbf{102}_a$, $\mathbf{102}_b$ (and when the mounting portion 304 is secured to the stabilizing brace 204), the first and second restraint tabs 312, 316 serve to directly restrain or limit the first and second surface tiles $\mathbf{102}_a$, $\mathbf{102}_b$ (e.g., via contact between a bottom surface of the restraining tabs 312, 316 and a bottom surface of the openings 122) from moving (e.g., lifting) away from the stabilizing brace 204 due to wind gusts, disruptive vibrations, and/or the like.

The connection portion 336 may be broadly configured to connect (e.g., rigidly) the restraint portion 308 to the mounting portion 304 (and thus to the stabilizing brace 204) and may be designed to fit within a gap 400 defined (e.g., via spacers 224) between the first and second adjacent, abutting surface tiles $\mathbf{102}_a$, $\mathbf{102}_b$. In one arrangement, the connection portion 336 may include a first connection element 340 that interconnects the first restraint tab 312 to a first part 364 of the mounting portion 304 and a second connection element 344 that interconnects the second restraint tab 312 to a second part 368 of the mounting portion 304. In one arrangement, and although not shown in FIG. 6, the first restraint tab 312, first connection element 340 and first part 364 of the mounting portion 308 may collectively form a first section of the restraint member 300 that is biased away from a second section of the restraint member 300 defined by the second restraint tab 316, second connection element 344 and second part 368 of the mounting portion 308. For example, the first connection element 340 and the second connection element 344 may diverge away from each other in the unbiased state. This arrangement advantageously allows for separation of the first and second sections away for each other to allow for insertion of the stabilizing brace 204 between the first and second sections and into the mounting cavity 327 of the mounting portion 304. Furthermore, this arrangement serves to force or urge the first and second restraint tabs 312, 316 further into the openings 122 in the outer edge portions 120 of the first and second surface tiles $\mathbf{102}_a$, $\mathbf{102}_b$ to increase the holding force of the first and second restraint tabs 312, 316 on the first and second surface tiles $\mathbf{102}_a$, $\mathbf{102}_b$.

The restraint member 300 may be formed in any appropriate manner and of any appropriate materials. In one arrangement, the restraint member 300 may be formed of an elongated piece of sheet metal of any appropriate gauge (e.g., at least about 28 gauge; not greater than about 6 gauge) so as to form a single, unitary structure. For instance, the piece of sheet metal may be appropriately shaped or formed (e.g., bent, folded, stamped, etc.) to form the mounting portion 304, restraint portion 308, and connection portion 336. In another arrangement, the mounting portion 304, restraint portion 308, and connection portion 336 may each initially be in the form of respective pieces of material which may be appropriately secured together (e.g., via welding or the like) to form the restraint member 300. As an alternative to forming the restraint member 300 from sheet metal, the restraint member 300 may also be constructed in other manners (e.g., via thermoforming, extrusion, pultrusion, etc.) and/or from other materials (e.g., plastics, metals, fiber reinforced composites, etc.).

One method for constructing the elevated building surface assembly 100 will now be described, although numerous other methods and manners of constructing the assembly 100 are also envisioned. Initially, a plurality of support pedestals 201 may be appropriately located upon a fixed surface with any appropriate predetermined spacing between the support pedestals 201 and in any appropriate arrangement, such as a plurality of substantially linear rows and columns of support pedestals 201 (e.g., such as perpendicular rows and columns as shown in FIG. 1). Part of this step may in some situations include aligning (e.g., leveling) the top surfaces 222 of the support pedestals 201 via adjusting (e.g., rotating) the base and support member extensions 214, 219 relative to each other. This step may also include appropriately aligning, orienting or adding spacer tabs 224 in a manner to allow a desired building surface 101 to be formed.

The method may also include attaching a plurality of stabilizing braces 204 between adjacent pairs of support pedestals 201, such as between first and second adjacent support pedestals $\mathbf{201}_a$, $\mathbf{201}_b$ in FIG. 5. In one arrangement, one or more telescoping and/or non-telescoping stabilizing braces 204 (e.g., one or more of $\mathbf{204}_a$, $\mathbf{204}_b$, $\mathbf{204}_c$, $\mathbf{204}_d$, $\mathbf{204}_e$) may be secured between adjacent pairs of support pedestals 201 as discussed previously. For instance, two or more stabilizing braces 204 may be secured between the first and second adjacent support pedestals $\mathbf{201}_a$, $\mathbf{201}_b$ at different heights as shown in FIG. 5. However, it is to be understood that the stabilizing braces 204 to which the restraint members 300 may be attached are not limited to those disclosed herein. As just one example, other forms type of stabilizing members and/or manners of securing stabilizing members between adjacent support pedestals are also envisioned such as those disclosed in U.S. Pat. No. 8,429,860 which is assigned to the assignee of the present application and which is hereby incorporated herein by reference in its entirety as if set forth in full.

The mounting portions 304 of one or more restraint members 300 may also be secured to one or more stabilizing braces 204, such as via separating or spreading apart the first and second restraint tabs 312, 316 and connection elements 340, 344 to allow for receipt of the stabilizing brace 204 in the mounting cavity 327 of the mounting portion 304. See FIGS. 5 and 7. In one arrangement, a respective restraint member 300 may interconnect each stabilizing brace 204 to at least one surface tile 102 of the assembly 100. In another arrangement, a respective restraint member 300 may only be interconnected between stabilizing braces 204 and respective surface tiles 102 that are more susceptible to uplift forces from winds and/or disruptive vibrations (e.g., surface tiles adjacent an outer perimeter of the elevated flooring surface 101). In the case where two or more stabilizing braces 204 are secured between a particular pair of adjacent support pedestals (e.g., first and second support pedestals $\mathbf{201}_a$, $\mathbf{201}_b$ in FIG. 5), respective restraint members 300 may be interconnected between each of the stabilizing braces 204 and the first and second abutting, adjacent surface tiles $\mathbf{102}_a$, $\mathbf{102}_b$. For instance, the mounting portions 304 of each of such restraint members 300 may be secured to their respective stabilizing braces 204 at a different location along the length between the first and second support pedestals $\mathbf{201}_a$, $\mathbf{201}_b$, where the restraint portions 308 are configured to be inserted into different openings 122 in the outer edge segments 120 of the first and second abutting, adjacent surface tiles $\mathbf{102}_a$, $\mathbf{102}_b$ along the length of the outer edge segments 120.

In one arrangement, a single restraint member 300 may be configured to be secured to and/or otherwise disposed adjacent two or more stabilizing braces 204 extending between first and second adjacent support pedestals 201. With reference to FIGS. 5-7, for instance, a portion of the first and second connection elements 340, 344 of the restraint member 300 may be appropriately shaped (e.g., during manufacturing) to form another mounting portion 304 configured to receive another stabilizing brace 204 disposed at a different height along the first and second support pedestals $\mathbf{201}_a$, $\mathbf{201}_b$ than the first mounting portion 304. As another example, the first and second connection elements 340, 344 may be appropriately shaped to form a single elongated mounting portion 304 configured to receive the two or more stabilizing braces 204. In this regard, either of such single restraint members 300 may be separated and placed about the pair of stabilizing braces 204. In either case, at least a portion of the connection portion 336 may still need to be long and narrow enough to pass through the gap 400 defined between first and second surface tiles $\mathbf{102}_a$, $\mathbf{102}_b$.

The mounting portions 304 of each of the restraint members 300 may in some arrangements be appropriately fastened to the respective stabilizing braces 204 such as via inserting fasteners 352 through the mounting portions 304 and stabilizing braces 204, adhering or welding the mounting portions 304 to the stabilizing braces 204, and/or the like. It is noted that mounting portions 304 may be disposed adjacent, secured and/or fastened relative to the stabilizing braces 204 either before or after the stabilizing braces 204 are secured between adjacent pairs of support pedestals 201. In any event, the method also includes placing corner portions 116 of surface tiles 102 on the support pedestals 201 to form an elevated building surface and receiving restraint portions 308 of the restraint members 300 in openings 122 in the outer edge segments 120 of the surface tiles 102.

With reference to FIGS. 5 and 7, for instance, the corner portions 116 of the first and second surface tiles $\mathbf{102}_a$, $\mathbf{102}_b$ may be placed on the top surfaces 222 of the first and second adjacent support pedestals $\mathbf{201}_a$, $\mathbf{201}_b$ and the outer edge portions 120 of the first and second surface tiles $\mathbf{102}_a$, $\mathbf{102}_b$ may be urged towards the first and second restraint tabs 312, 316 so that the first and second restraint tabs 312, 316 enter the openings 122 in the respective outer edge portions 120. In one arrangement, and as discussed previously, the first and second restraint tabs 312, 316 may be naturally (e.g., in a relaxed state) biased away from their relative positioning illustrated in FIGS. 5-7. In this regard, urging of the first and second surface tiles $\mathbf{102}_a$, $\mathbf{102}_b$ towards the restraint member 300 so that the restraint tabs 312, 316 enter the openings 122 in the outer edge portions 120 may be against such biasing force of the restraint member 300 which may serve to more forcefully restrain the surface tiles 102 against movement in a direction away from the stabilizing braces 204.

Figure 8:
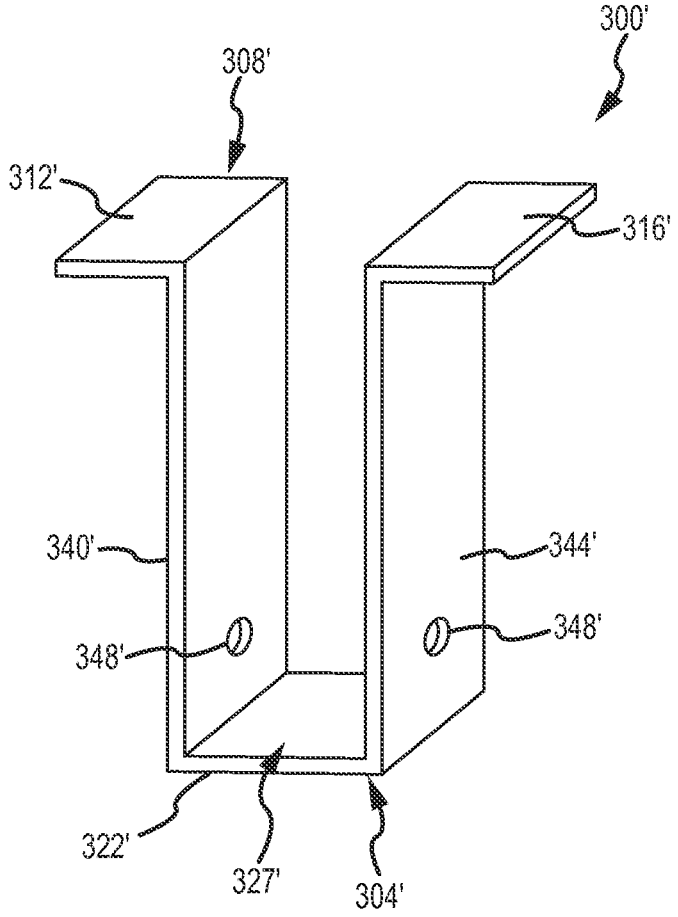
FIG. 8 is a perspective view of the restraint member of FIGS. 5-7 according to another embodiment.

It will be readily appreciated that many deviations may be made from the specific embodiments disclosed in the specification without departing from the spirit and scope of the invention. For instance, while the openings 122 have been illustrated as being disposed at a substantial midpoint of the outer edge segment 120 of the surface tiles 102, the opening 122 may be disposed at one or more other locations along the outer edge segments 120. As another example, FIG. 8 illustrates another embodiment of the restraint member 300' where the first and second connection elements 340', 344' both form a portion of the mounting portion 304' and interconnect the mounting portion 304' to the restraint portion 308'. In this embodiment, the stabilizing brace 204 may be slid between the first and second connection elements 340', 344' (or the restraint member 300' may be moved so that the stabilizing brace 204 slides between the first and second connection elements 340', 344') until the stabilizing brace 204 abuts lower wall 322' of mounting portion 304'. A fastener 352 (not shown in FIG. 8) may be inserted through mounting apertures 348' and an aligned aperture in the stabilizing brace 204.

In one variation, a series of mounting apertures 348 may be defined through each of the connection elements 340', 344' between the bottom wall 322 and first and second restraint tabs 312, 316 to allow the restraint member 300' to be able to accommodate differing distances between the stabilizing brace 204 to which its mounting portion 304' is secured and the surface tile(s) 102 to which its restraint portion 308 is secured. As one example, the restraint member 300' may be manipulated so as to dispose a stabilizing member 204 between the first and second connection elements 340', 344' to allow the corner portions 116 of a surface tile 102 to be placed on the top surfaces 222 of adjacent support pedestals 201 and the opening 122 in the outer edge portion 120 to receive the restraint portion 308 (e.g., the first restraint tab 312). Thereafter, an end of a fastener 352 may be inserted through one or more apertures 348 in at least one of the first and second connection elements 340', 344' and through one or more aligned apertures in the stabilizing brace 204 to secure (e.g. non-movably) the restraint member 300' relative to the stabilizing brace and surface tile 102. Of course, a nut may be threaded onto the end of the fastener 352 as necessary. In this variation, the fastener 352 may receive the brunt of any uplift forces acting on the restraint member 300' in the event that the bottom wall 322 of the mounting portion 304' is no longer in contact with the stabilizing brace.

In the event there are no apertures disposed through the first and second connection elements 340', 344' and/or stabilizing brace 204, an installer may simply drill one or more bores through the first and second connection elements 340', 344' and the stabilizing brace 204 to form one or more series of aligned apertures and then insert one or more fasteners through the bores to secure the restraint member 300' relative to the stabilizing brace 204. When a substantially exact spacing between a stabilizing brace and the restraint portion 308 (and thus surface tiles to be attached to the restraint portion 308) is already known, the installer can identify the corresponding location on the restraint member 300' and then appropriately secure the stabilizing brace 204 relative to the restraint member 300'. Furthermore, other manners of securing the restraint member 300' relative to the stabilizing brace 204 may be employed such as flexible clips, welding, and/or the like.

In other arrangements, the mounting portion 304 need not necessarily be fastened to stabilizing braces 204 via fasteners, clips, adhesives, or the like. For instance, the mounting portion 304 of the embodiment of the restraint member 300 shown in FIGS. 5-7 extends around a substantial entirety of the periphery or circumference of the stabilizing brace 204. In this regard, any attempted relative movement between the restraint member 300 and the stabilizing brace 204 in upward/downward directions (e.g., parallel to a central axis of the support pedestals 201 and perpendicular to the stabilizing brace 204) or forward and backward directions (e.g., perpendicular to the stabilizing brace 204) would be substantially immediately inhibited due to the configuration of the mounting portion 304. While relative sliding movement of the mounting portion 304 relative to the stabilizing brace 204 may still technically be possible, any such movement may in actuality be negligible due to the weight of the surface tiles 102, the abutting nature of the surface tiles with other surface tiles 102 (which would tend to limit side to side/sliding movement of the surface tiles 102 and thus of the mounting portion 304 relative to the stabilizing brace 204), and the like.

In a further embodiment, the connection portion 336 of the restraint member 300 may include only a single connection element that interconnects the mounting portion 304 and the restraint portion 308. In one arrangement, the restraint portion 308 may include first and second restraint tabs 312, 316 that are or are not naturally biased away from each other (e.g., away from the position shown in FIGS. 5-7). In another arrangement, the mounting portion 304 may include one or more walls that are disposable against a portion of a stabilizing brace 204 and/or fastenable thereto via fasteners, clips, etc. In a further arrangement, the mounting portion may include first and second parts 364, 368 that are biased towards each other in a relaxed state so that such parts may be separated or otherwise spread apart to allow for introduction of a stabilizing brace 204 therebetween whereafter the first and second parts would close or compress about the stabilizing brace 204. For instance, one or more corners or junctions of the first and second parts 364, 368 (e.g., where 340, 344 meet 326 in FIG. 6) may be appropriately rounded or tapered to facilitate introduction of a stabilizing brace 204 therebetween.

Figure 9:
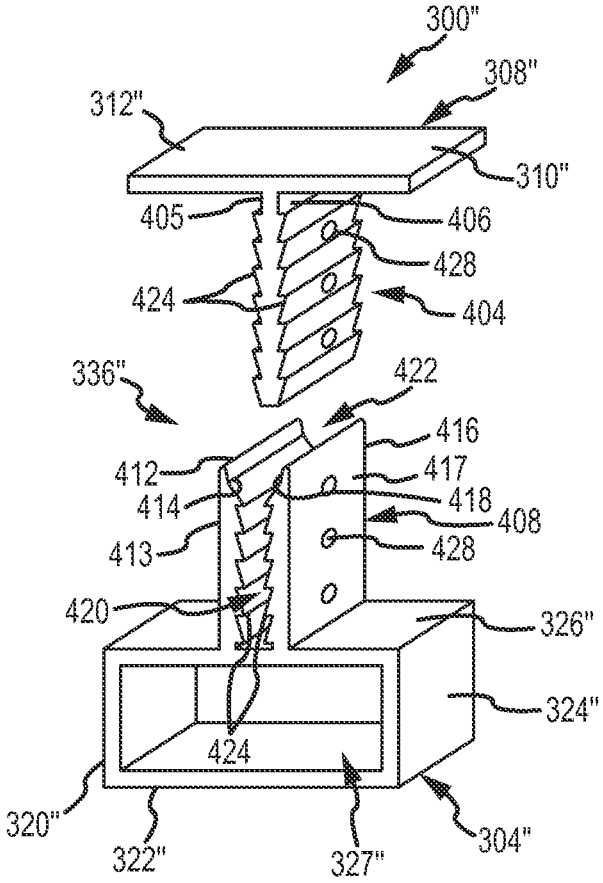
FIG. 9 is a perspective view of another embodiment of the restraint member of FIGS. 5-7.

Turning now to FIG. 9, another embodiment of the restraint member 300" is shown in which the connection portion 336" includes first and second connection elements such as first and second ratchet members 404, 408 that are configured to allow for sliding engagement therebetween in a first relative direction of movement and inhibit sliding movement therebetween in an opposed second relative direction of movement. For instance, the restraint portion 308" may be in the form of a one-piece member including the first and second restraint tabs 312", 316", where the first ratchet member 404 extends away from a surface of the restraint portion 308". As shown, the first ratchet member may include first and second opposed surfaces 405, 406, each including a series of ratchet teeth 424 extending therealong. The second ratchet member 408 may include first and second ratchet elements 412, 416 that are configured to form a space or gap 420 therebetween for receipt of the first ratchet member 404. The first and second ratchet elements 412, 416 may include respective outer surfaces 413, 417 and inner surfaces 414, 418, where each of the inner surfaces 414, 418 includes a series of ratchet teeth 424 extending therealong that are respectively configured to engage with the series of ratchet teeth 424 on the first and second surfaces 405, 406 of the first ratchet member 404.

More specifically, the teeth 424 of the second ratchet member 408 are appropriately shaped or configured to allow for insertion of the first ratchet member 404 into the gap 420 via an open end 422 of the gap 420 so as to move the restraint portion 308" and mounting portion 304" closer together while at the same time inhibiting relative movement between the first and second ratchet members 404, 408 in a direction that moves the restraint portion 308" and mounting portion 304" apart from each other. In one arrangement, the teeth 424 of the first ratchet member 404 may be generally pointed in an "upward" direction (e.g., towards the restraint portion 308") while the teeth 424 of the second ratchet member 408 may be generally pointed in a "downward" direction (e.g., towards the mounting portion 304"). In this regard, and with reference to FIG. 9, it can be seen how this configuration allows for sliding or snapping movement of the teeth 424 of the first ratchet member 404 past the teeth 424 of the second ratchet member 408 so that the first ratchet member 404 can be urged into the gap 420 towards the mounting cavity 327". However, any attempted movement of the first or second ratchet member 404, 408 in an opposed direction would cause the teeth 424 of the first ratchet member 404 to dig in between the teeth 424 of the second ratchet member 408 and vice versa thus inhibiting such movement.

In use, the first and second ratchet elements 412, 416 may be spread apart to allow for receipt of a stabilizing brace 204 through the gap 420 and into the mounting cavity 327" of the mounting portion 304" (e.g., similar to how the first and second restraint tabs 312, 316 and connection elements 340, 344 may be spread apart in the embodiment of FIG. 6). After the stabilizing brace 204 has been received in the mounting cavity 327", the first and second ratchet elements 412, 416 may be configured to snap or spring back to the position illustrated in FIG. 9 whereby the gap 420 is of a size (e.g., width) that allows for ratcheting of the first ratchet member 404 relative to the second ratchet member 408. In one variation, the first and second ratchet elements 412, 416 may be configured to return to a position in which the first and second ratchet elements 412, 416 are closer together than shown in FIG. 9, such as in contact or near contact with each other.

In any case, one of the first and second ratchet members 404, 408 may be urged towards the other of the first and second ratchet members 404, 408 such that the first ratchet member 404 enters the open end 422 of the gap 420 and ratchets into the gap 420 towards the mounting cavity 327". In the event that the first and second ratchet elements 412, 416 are in contact or near contact, urging of the first ratchet member 404 into the gap 420 may serve to urge the first and second ratchet elements 412, 416 apart such that the first and second ratchet elements 412, 416 exert a biasing force against the first ratchet member 404 and thus further secure the first and second ratchet members 404, 408 relative to each other. At any appropriate time, the first and second restraint tabs 312", 316" may be inserted into respective openings 422 in the outer edge segments 120 of adjacent surface tiles 102 as discussed herein. If necessary, the mounting and restraint portions 304", 308" may be urged towards each other in any appropriate manner to further the first and second ratchet members 404, 408 relative to each other and thus further inhibit separation of the mounting and restraint portions 304", 308". At this point, any uplift forces or the like acting on the surface tiles 102 with which the first and second restraint tabs 312", 316" are engaged may be resisted by the bottom wall 327" of the mounting portion 304" acting against the stabilizing brace 204, the teeth 424 of the second ratchet member 408 engaging with the teeth 424 of the first ratchet member 404, and the first and second restraint tabs 312", 316" acting against the surface tiles 102.

It is noted that it is not necessary that the aforementioned steps are performed in the specific order described above. As just one example, the first and second restraint tabs 312", 316" may be inserted into the respective openings 422 in the outer edge segments 120 of adjacent surface tiles 102 before the first ratchet member 404 is inserted into the gap 420 of the second ratchet member 408. Furthermore, numerous modifications to the embodiment of the restraint member 300" shown in FIG. 9 are envisioned and encompassed within the scope of the present disclosure. In one variation, the first and second ratchet members 404, 408 may include respective series of apertures 428 that are configured to appropriately align upon receipt of the first ratchet member 404 within the gap 420 of the second ratchet member 408 and receive any appropriate fastener (e.g., bolt, screw, not shown) therethrough. This arrangement may further limit separation between the mounting and restraint portions 304", 308" of the restraint member 300".

In another variation, the first ratchet member 404 may be in the form of first and second ratchet elements (e.g., similar to the first and second ratchet elements 412, 416 of the second ratchet member 408) having ratchet teeth on inside surfaces thereof, where each of such first and second ratchet elements extends away from the surface of the restraint portion 308". In this variation, the first and second ratchet elements 412, 416 of the second ratchet member 408 may include ratchet teeth on the outer surfaces 413, 417 whereby the first and second ratchet elements 412, 416 of the second ratchet member 408 may inserted into a gap between the first and second ratchet elements of the first ratchet member 404 to allow for ratcheting engagement of the respective teeth of the first and second ratchet members 404.

Figure 10:
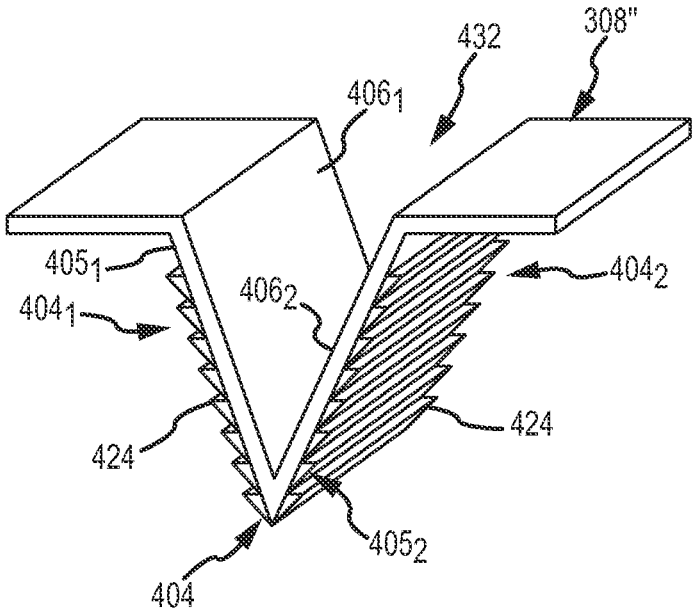
FIG. 10 is a perspective view of another embodiment of a restraint portion of the restraint member of FIG. 9.

Turning now to FIG. 10, another variation of the restraint portion 308'" is illustrated in which the first ratchet member 404 is in the form of first and second ratchet elements $\mathbf{404_1}$, $\mathbf{404_2}$ that are spread apart from each other to form a gap 432 therebetween in a relaxed configuration. Each of the first and second ratchet elements $\mathbf{404_1}$, $\mathbf{404_2}$ may include outer surfaces $\mathbf{405_1}$, $\mathbf{405_2}$, opposing inner surfaces $\mathbf{406_1}$, $\mathbf{406_2}$, and a series of teeth 424 disposed along the outer surfaces $\mathbf{405_1}$, $\mathbf{405_2}$. As opposed to a single piece of material as in the embodiment of FIG. 9, the first and second restraint tabs 312", 316" may be in the form of first and second pieces of material that are respective connected to the first and second ratchet elements $\mathbf{404_1}$, $\mathbf{404_2}$ (e.g., somewhat similar to the embodiments of FIGS. 6 and 8). In use, the first and second ratchet elements $\mathbf{404_1}$, $\mathbf{404_2}$ may be appropriately compressed to bring the inner surfaces $\mathbf{406_1}$, $\mathbf{406_2}$ closer together (e.g., adjacent, near contact, contact, etc.) and thereby reduce the size (e.g., width) of the gap 432. At any appropriate time, the first ratchet member 404 may be inserted into the open end 422 of the gap 420 between the first and second ratchet elements 412, 416 of the second ratchet member 408 (see FIG. 9) so that the teeth 424 of the first and second ratchet elements $\mathbf{404_1}$, $\mathbf{404_2}$ of the first ratchet member 404 engage with the first and second ratchet elements 412, 416 of the second ratchet member 408.

Once the teeth 424 of the first ratchet member 404 are engaged with those of the second ratchet member 408, the tendency of the first and second ratchet elements $\mathbf{404_1}$, $\mathbf{404_2}$ of the first ratchet member 404 to want to return to the position shown in FIG. 10 may cause the teeth 424 of the first and second ratchet elements $\mathbf{404_1}$, $\mathbf{404_2}$ of the first ratchet member 404 to more tightly engage with those of the first and second ratchet elements 412, 416 of the second ratchet member 408. While not shown, the first and second ratchet elements $\mathbf{404_1}$, $\mathbf{404_2}$ of the first ratchet member 404 may include one or more apertures 428 operable to align with the one or more apertures 428 of the first and second ratchet elements 412, 416 of the second ratchet member 408 for receipt of one or more fasteners. Furthermore, while respective series of teeth 424 have been illustrated as being disposed on the first and second ratchet members 404, 408, it is envisioned that the first and second ratchet members 404, 408 may alternatively include other forms of engagement features such as a flexible tab or clip on one of the first and second ratchet members 404, 408 and a corresponding series of openings or slots on the other of the first and second ratchet members 404, 408.

Figure 11:
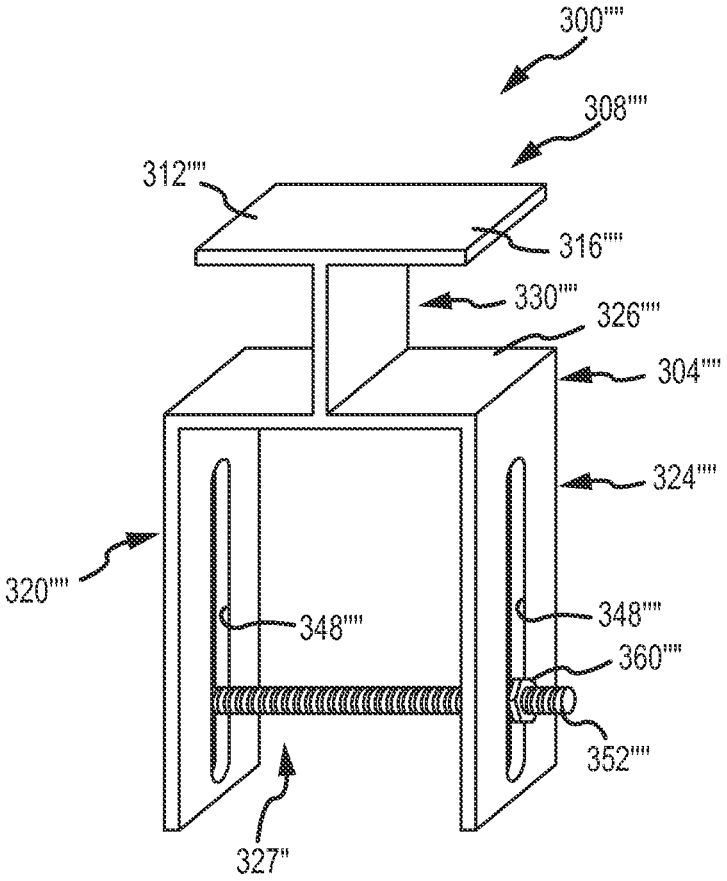
FIG. 11 is a perspective view of another embodiment of the restraint member of FIGS. 5-7.

With reference to FIG. 11, another embodiment of the restraint member 300"" is illustrated in which the mounting portion 304"" includes first and second side walls 320"", 324"" and a top wall 326"" but is free of a bottom wall (e.g., bottom wall 322 of FIGS. 6, 8 and 9). Each of the first and second side walls 320"", 324"" may include at least one aperture 348"" therein, such as a single elongated aperture (e.g., slot) as illustrated in FIG. 11, a series of apertures, etc. for receipt of at least one fastener 352"". The restraint portion 308"" may be in the form of a one-piece member including the first and second restraint tabs 312"", 316"" while the connection portion 336"" may be in the form of at least one member that rigidly connects the restraint portion 308"" to the top wall 326"" of the mounting portion 304'", where the connection portion 336"" is sized and shaped to fit through a gap 400 between adjacent surface tiles 102 (e.g., see FIG. 7).

In use, a stabilizing brace 204 may be introduced into the mounting cavity 327"" via a bottom of the mounting portion 304"", such as via an operator placing the mounting portion 304"" over a top of the stabilizing brace 204 until the top wall 326 is resting on a top wall 211 of the stabilizing brace 204 (e.g., see top wall 211 in FIG. 5). If not already inserted, the operator may insert a fastener 352"" through the apertures 348"" as shown in FIG. 11. In any case, the operator may slide the fastener 352"" upwards into contact or near contact with a bottom wall 213 of the stabilizing brace 204 (e.g., see bottom wall 213 in FIG. 7) and then tighten the same with a nut 360"" or the like with the fastener 352"" in contact or near contact with the bottom wall 213 of the stabilizing brace 204. At this point, any uplift forces or the like acting on the surface tiles 102 with which the first and second restraint tabs 312"", 316"" are engaged may be resisted by the fastener 352"" acting against the bottom wall 213 of the stabilizing brace 204 and the first and second restraint tabs 312"", 316"" acting against the surface tiles 102.

In a further arrangement, the first and second restraint tabs 312, 316 may be in the form of first and second pins, rods or the like that are respectively configured to be inserted into correspondingly shaped openings 122 in the outer edge segments 120 of adjacent surface tiles 102. For instance, each pin may be a generally elongated, cylindrical member having a bulbous feature, rib, or projection near a free end thereof that is configured to be received within or snap past a corresponding feature in the opening 122 in the outer edge segment 120 (e.g., so as to maintain engagement between the pin and the respective surface tile 120). Each pin may be constructed of any appropriate material such as metal, plastic, wood, composites, and/or the like. In one arrangement, any appropriate adhesive may be used to further secure the pins or tabs to the insides of the openings 122. In one embodiment, the pin may be spring loaded (e.g., similar to a wrist-band pin for a watch) so that the ends are configured to be biased away from each other. This arrangement may be advantageous with surface tiles 102 (e.g., ceramic tiles) in which it is impractical to form openings 122 in the form of elongated slots/slits as shown in FIG. 5 (e.g., but in which it is practical to form circular openings).

Figure 12:
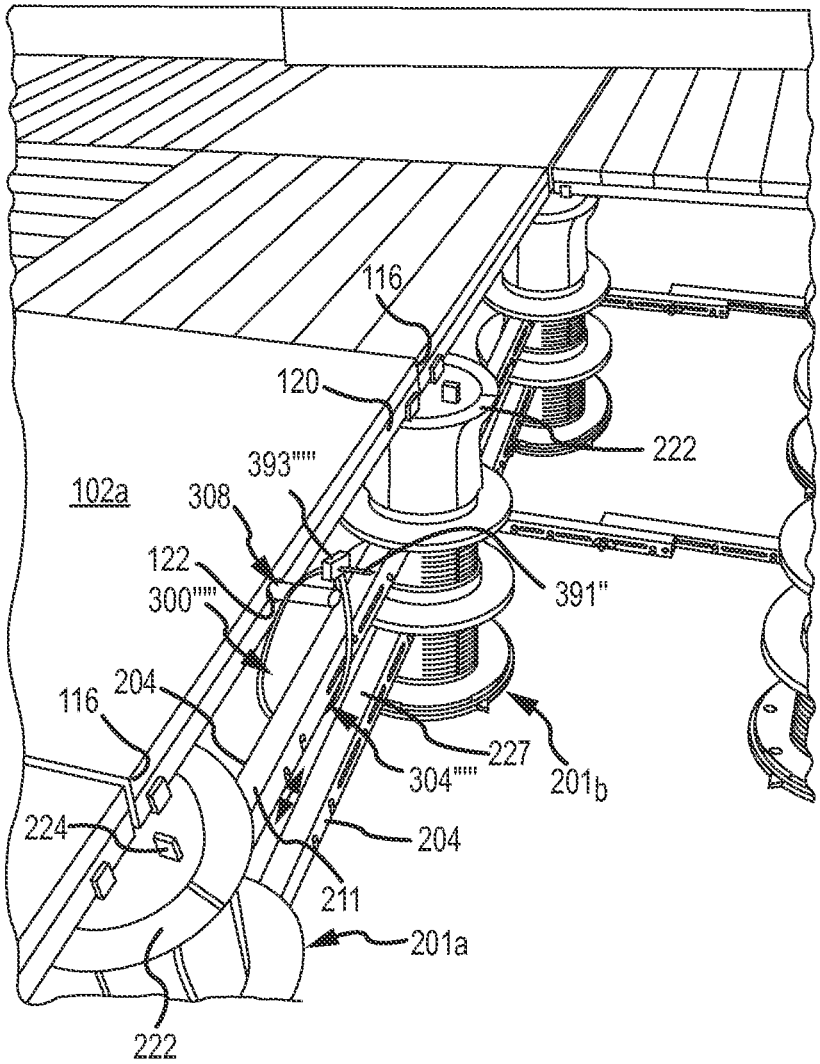
FIG. 12 is a perspective view of another embodiment of the restraint member of FIGS. 5-7.

Turning now to FIG. 12, another embodiment of the restraint member 300""" is shown in which the mounting portion 304""" is in the form of a flexible or elastic member such as an elongated cable tie (e.g., zip tie) and/or the like and the restraint portion 308""" is in the form of an elongated member (e.g., cylindrical pin or the like as discussed above) having first and second ends (e.g., first and second restraint portions) that are configured to be received within correspondingly shaped openings 122 in the outer edge segments 120 of adjacent surface tiles 102 (one of the adjacent surface tiles 102 has been removed for clarity). For instance, after at least one of the ends of the restraint portion 308""" has been inserted into an opening 122 of a surface tile 102, the mounting portion 304'''' may be wrapped about an upper surface of the restraint portion 308'''' and about a lower surface of a stabilizing brace 204 and then an end 391'''' may be inserted in a first direction through a cage 393'''' of the mounting portion 304'''' to inhibit movement thereof in an opposing second direction. The mounting and restraint portions 304'''', 308'''' may then be considered respectively secured to the stabilizing brace 204 and the surface tiles 102 to restrain or limit movement of the adjacent surface tiles 102 (and the restraint portion 308'''') in a direction away from the stabilizing brace 204 and the support structure 200 as a whole. While the restraint portion 308'''' has been illustrated in the form of an elongated cylindrical pin, the restraint portion 308'''' may take other forms such as where a central portion of the restraint portion 308'''' includes a U or V shape that is adapted to receive the mounting portion 304''''.

While various embodiments of the present invention have been described in detail, it is apparent that modifications and adaptations of those embodiments will occur to those skilled in the art. However, is to be expressly understood that such modifications and adaptations are within the spirit and scope of the present invention.

What is claimed is:

1. A method for restraining surface tiles of an elevated building surface that comprises a plurality of support pedestals on a fixed surface in a spaced-apart relationship, wherein stabilizing braces are attached to adjacent ones of the plurality of support pedestals to interconnect the adjacent support pedestals, wherein the method comprises the steps of:

securing mounting portions of restraint members to the stabilizing braces;

placing corner portions of surface tiles on the support pedestals to form an elevated building surface; and receiving restraint portions of the restraint members in openings in outer edge segments of the surface tiles.

2. The method of claim 1, wherein the securing step comprises:

securing mounting surfaces of the mounting portions of the restraint members to the stabilizing braces.

3. The method of claim 2, further comprising:

inserting fasteners through the mounting portions of the restraint members and into the stabilizing braces to secure the restraint members to the stabilizing braces.

4. The method of claim 3, further comprising:

securing opposing first and second sides of the stabilizing braces to opposing first and second mounting surfaces of the mounting portions of the restraint members.

5. The method of claim 2, further comprising:

securing opposing first and second sides of the stabilizing braces to opposing first and second mounting surfaces of the mounting portions of the restraint members.

6. The method of claim 1, wherein the placing and receiving steps occur substantially simultaneously for each of the surface tiles.

7. The method of claim 1, wherein the securing step occurs before the stabilizing braces are attached to the support pedestals.

8. The method of claim 1, wherein the securing step occurs during or after the stabilizing braces are attached to the support pedestals.

9. The method of claim 1, wherein the mounting portions comprise zip ties, and wherein the securing step comprises:

wrapping the zip ties at least partially around the stabilizing braces and the restraint portions; and inserting ends of the zip ties through cages of the zip ties.

10. The method of claim 1, wherein the receiving step comprises:

receiving a first restraint element of the restraint members in the opening in the outer edge portion of a first of the surface tiles; and receiving an opposed second restraint element of the restraint members in the opening in the outer edge portion of an abutting second of the surface tiles.

11. The method of claim 10, wherein the first and second restraint elements are biased away from each other and into the respective openings in the outer edge segments of the first and second abutting surface tiles.

12. The method of claim 1, further comprising:

engaging a first connection element attached to one of the restraint portions or mounting portions of the restraint members with a second connection element attached to the other of the restraint portions.

13. The method of claim 12, wherein the engaging comprises:

ratchetingly engaging at least a first tooth on one of the first and second connection elements with a series of teeth on the other of the first and second connection elements.

14. The method of claim 12, wherein the engaging comprises:

receiving one of the first and second connections elements within a gap disposed within the other of the first and second connection elements.

15. An elevated building surface assembly, the assembly comprising:

a plurality of support pedestals disposed in spaced-apart relation on a fixed surface, the support pedestals comprising:

a lower portion;

an upper portion; and a central section extending generally perpendicularly between the lower and upper portions;

a plurality of stabilizing braces operatively attached to and interconnecting adjacent support pedestals, wherein first and second ends of the stabilizing braces are attached to the central sections of the adjacent support pedestals;

a plurality of building surface components operatively disposed on the upper portions of the support pedestals; and a plurality of restraint members interconnecting the building surface components to the stabilizing braces, the restraint members comprising:

a mounting portion secured to one of the plurality of stabilizing braces; and a restraint portion secured to an outer edge segment of at least a first of the plurality of building surface components.

16. The elevated building surface assembly of claim 15, wherein the restraint portion of each restraint member is configured to be operatively positioned within an opening disposed in the outer edge segment of the first building surface component.

17. The elevated building surface assembly of claim 16, wherein the opening is disposed at a substantial midpoint along a length of the outer edge segment.

18. The elevated building surface assembly of claim 16, wherein the restraint portion of the restraint member is further configured to be operatively positioned within an opening disposed in the outer edge segment of a second of the plurality of building surface components that abuts the outer edge segment of the first building surface component.

19. The elevated building surface assembly of claim 18, wherein the restraint portion of the restraint member comprises first and second restraint elements that are respectively configured to be operatively positioned within the opening in the outer edge segment of the first building surface component and within the opening in the outer edge segment of the second building surface component.

20. The elevated building surface assembly of claim 19, wherein the first and second restraint elements are biased away from each other.

21. The elevated building surface assembly of claim 15, wherein the mounting portion of each restraint member is configured to be disposed about at least a portion of a periphery of the stabilizing brace.

22. The elevated building surface assembly of claim 15, wherein the stabilizing brace comprises opposing top and bottom surfaces, and wherein the mounting portion is configured to be disposed underneath the bottom surface of the stabilizing brace.

23. The elevated building surface assembly of claim 22, wherein the mounting portion of each restraint member is further configured to be disposed over the top surface of the stabilizing brace.

24. The elevated building surface assembly of claim 15, wherein the mounting portion of the restraint member comprises at least a first mounting wall disposable against the stabilizing brace.

25. The elevated building surface assembly of claim 24, wherein the first mounting wall is disposable against a first surface of the stabilizing brace, and wherein the mounting portion of the restraint member comprises a second mounting wall disposable against an opposed second surface of the stabilizing brace.

26. The elevated building surface assembly of claim 25, wherein each of the first and second mounting walls comprises at least one mounting aperture for receipt of a fastener to secure the restraint member to the stabilizing brace.

27. The elevated building surface assembly of claim 25, wherein the restraint portion of the restraint member comprises first and second restraint elements that are respectively configured to be operatively positioned within openings in the outer edge segments of the first building surface component and an abutting second of the plurality of building surface components, wherein the first restraint element is connected to the first mounting element, and wherein the second restraint element is connected to the second mounting element.

28. The elevated building surface assembly of claim 15, wherein the mounting portion comprises an elongated flexible member interconnected between the restraint portion and the one of the plurality of stabilizing braces.

29. The elevated building surface assembly of claim 28, wherein the restraint portion comprises a pin member secured to the outer edge segments of the first and a second of the plurality of building surface components.

30. The elevated building surface assembly of claim 15, wherein the restraint members further comprise a connection portion interconnecting the restraint and mounting portions.

31. The elevated building surface assembly of claim 30, wherein the connection portion comprises first and second connection elements.

32. The elevated building surface assembly of claim 31, wherein the first connection element connects a first restraint element of the restraint portion of each restraint member to a first portion of the mounting portion of the restraint member, and wherein the second connection element connects a second restraint element of the restraint portion of the restraint member to a second portion of the mounting portion of the restraint member.

33. The elevated building surface assembly of claim 32, wherein the first and second connection elements are separable to allow for introduction of a stabilizing brace therethrough and into a mounting cavity of the mounting portion of the restraint member.

34. The elevated building surface assembly of claim 31, wherein the first connection element comprises a first ratchet member, wherein the second connection element comprises a second ratchet member, wherein at least one of the first and second ratchet members is movable relative to the other of the first and second ratchet members in a first direction of ratcheting engagement between the first and second ratchet members, and wherein the first and second ratchet members are non-movable relative to each other in an opposed second direction.

35. The elevated building surface assembly of claim 34, wherein the first ratchet member is connected to the restraint portion of the restraint member, and wherein the second ratchet member is connected to the mounting portion of the restraint member.

36. The elevated building surface assembly of claim 15, wherein each restraint member comprises a single, unitary structure.

37. A support structure for elevating a building surface above a fixed surface, the support structure comprising:

a plurality of support pedestals disposed in spaced-apart relation on the fixed surface, the support pedestals comprising:

a lower portion;

an upper portion; and a central section extending between the lower and upper portions;

a plurality of stabilizing braces interconnecting adjacent of the plurality of support pedestals, wherein first and second ends of the stabilizing braces are attached to the central sections of the adjacent support pedestals, and wherein the stabilizing braces are disposed generally horizontally relative to the fixed surface; and a plurality of restraint members comprising:

a mounting portion secured to one of the plurality of stabilizing braces; and a restraint portion secured to an outer edge segment of at least a first of a plurality of surface tiles.

38. The support structure of claim 37, wherein the restraint portion of each restraint member is configured to be operatively positioned within an opening disposed in the outer edge segment of the first building surface component.

39. The support structure of claim 38, wherein the restraint portion of the restraint member is further configured to be operatively positioned within an opening disposed in the outer edge segment of a second of the plurality of building surface components that abuts the outer edge segment of the first building surface component.

40. The support structure of claim 39, wherein the restraint portion of the restraint member comprises first and second restraint elements that are respectively configured to be operatively positioned within the openings in the outer edge segments of the first and second building surface components.

41. The support structure of claim 37, wherein the mounting portion of each restraint member comprises at least a first mounting opening, wherein the stabilizing brace is receivable in the first mounting opening.

42. The support structure of claim 41, wherein the mounting portion of the restraint member further comprises a second mounting opening, wherein the stabilizing brace is receivable in the second mounting opening.

43. The support structure of claim 42, wherein the first and second mounting openings face each other.

44. The support structure of claim 37, wherein the stabilizing braces comprise opposing top and bottom surfaces, and wherein the mounting portion of each restraint member is configured to be disposed underneath the bottom surface and over the top surface.

45. The support structure of claim 37, wherein the mounting portion comprises an elongated flexible member interconnected between the restraint portion and the one of the plurality of stabilizing braces, and wherein the restraint portion comprises a pin member secured to the outer edge segments of the first and a second of the plurality of building surface components.

46. The support structure of claim 37, wherein each restraint member further comprises a connection portion interconnecting the restraint and mounting portions, wherein the connection portion comprises first and second connection elements, wherein the first connection element comprises a first ratchet member, wherein the second connection element comprises a second ratchet member, wherein at least one of the first and second ratchet members is movable relative to the other of the first and second ratchet members in a first direction of ratcheting between the first and second ratchet members, wherein the first and second ratchet members are non-movable relative to each other in an opposed second direction, wherein the first ratchet member comprises first and second ratchet elements, and wherein the first and second ratchet elements of the first ratchet member are receivable within the gap disposed between the first and second ratchet elements of the second ratchet member.

* * * * *